US006897194B2

(12) United States Patent
Fan et al.

(10) Patent No.: US 6,897,194 B2
(45) Date of Patent: May 24, 2005

(54) FABRIC CONDITIONING COMPOSITIONS

(75) Inventors: Shimei Fan, Chicago, IL (US); Gary Cahill, Wirral (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 198 days.

(21) Appl. No.: 10/203,281

(22) PCT Filed: Jan. 22, 2001

(86) PCT No.: PCT/EP01/00637

§ 371 (c)(1),
(2), (4) Date: Nov. 18, 2002

(87) PCT Pub. No.: WO01/59200

PCT Pub. Date: Aug. 16, 2001

(65) Prior Publication Data

US 2003/0158068 A1 Aug. 21, 2003

(30) Foreign Application Priority Data

Feb. 8, 2000 (GB) ..... 0002877

(51) Int. Cl.[7] ..... C11D 1/835
(52) U.S. Cl. ..... 510/527; 510/522
(58) Field of Search ..... 510/515, 516, 510/522, 527

(56) References Cited

U.S. PATENT DOCUMENTS 4,137,180 A 1/1979 Naik et al.
5,574,179 A 11/1996 Wahl et al.
5,578,234 A 11/1996 Corona, III et al.
5,916,863 A * 6/1999 Iacobucci et al. ..... 510/329

FOREIGN PATENT DOCUMENTS

| | | |
|---|---|---|
| EP | 0 122 141 B1 | 11/1989 |
| EP | 0 409 502 B1 | 11/1995 |
| EP | 0 728 737 | 8/1996 |
| EP | 0 240 727 | 10/1997 |
| EP | 0 638 639 | 4/2000 |
| WO | 89/11522 | 11/1989 |

OTHER PUBLICATIONS

UK Search Report No. GB 0002877.9 dated Apr. 26, 2000, 1 page.

International Search Report No. PCT/EP 01/00637 dated Jun. 5, 2001, 4 pp.

EPO Patent Abstracts of Japan vol. 14, No. 211 for JP 02 047362, 1 page.

* cited by examiner

*Primary Examiner*—John R. Hardee
(74) *Attorney, Agent, or Firm*—Ellen Plotkin

(57) ABSTRACT

In a concentrated fabric softening composition comprising an aqueous dispersion of less than 30% by weight of quaternary ammonium fabric softening material which comprises two $C_{12}$–$C_{22}$ alkyl or alkenyl groups connected to the molecule via at least one ester link, such as ester quat, improved stability of the viscosity on storage is obtained by including an unsaturated $C_8$–$C_{24}$ fatty acid, wherein the weight ratio of quaternary ammonium material to unsaturated material is greater than 10:1.

5 Claims, No Drawings

FABRIC CONDITIONING COMPOSITIONS

TECHNICAL FIELD

The present invention relates to fabric conditioning compositions. In particular, the present invention relates to fabric conditioning compositions with enhanced viscosity stability characteristics.

BACKGROUND AND PRIOR ART

Fabric conditioners are commonly used to deposit a softening compound onto a fabric. Typically, such compositions contain a water-insoluble quaternary ammonium fabric softening agent dispersed in water at a level of softening agent up to 7% by weight, in which case the compositions are considered dilute, or at levels from 7% to 30% by weight, in which case the compositions are considered concentrates.

Fabric conditioning super concentrates can be provided which have in excess of 30% by weight fabric conditioner. However, such compositions need to be diluted upon use.

One of the problems associated with dilute and concentrated fabric softening compositions is the physical instability of such compositions when stored. Physical instability manifests itself as a thickening on storage of the compositions to a level where the composition can no longer be poured and can even lead to the formation of a gel which cannot be redispersed. This problem is accentuated by having a concentrated composition and by storage at low or high temperatures. With concentrated compositions comprising biodegradable ester-linked quaternary ammonium compounds, the problem of physical instability is more acute than with compositions comprising traditional quaternary ammonium compounds not having any ester links.

Conventional dilute fabric conditioners frequently contain an electrolyte such as calcium chloride to maintain the formation in a pourable condition. However, the formation of a stable concentrated product is not so easily achieved. The viscosity, pourability and flowability characteristics of conventional fabric conditioners are not maintained if the level of cationic softening active exceeds 8% by weight of the composition, even in the presence of calcium chloride. In such concentrated systems, phase separation or gelling occurs when the level of cationic softening agent exceeds 8% by weight.

EP-A-0409502 in the name of Unilever PLC discloses fabric softening compositions which comprise biodegradable quaternary ammonium compounds, which compositions are of acceptable stability. They contain a $C_8$–$C_{28}$ fatty acid material or salt thereof. The weight ratio of quaternary ammonium material to fatty acid is in the range 10:1 to 1:10.

WO 89/11522 in the name of Henkel KGaA discloses liquid laundry-conditioning agents containing quaternary ammonium compounds in combination with fatty acid in a ratio of 10:1 to 1:3. The compositions have acceptable stability and give good absorbency to textiles treated with them. The ratio of quaternary ammonium material to fatty acid is in the range 10:1 to 1:3.

EP-A-0122141 in the name of Unilever PLC discloses a liquid fabric softening composition containing a water soluble cationic fabric softener, a nonionic material of specified HLB and an electrolyte. The compositions have improved viscosity stability. The nonionic material may include $C_8$–$C_{24}$ fatty acids. Biodegradable quaternary ammonium material is not specifically mentioned. The ratio of quaternary ammonium material to nonionic material is less than 5:1.

Although general stability is approached in EP-A-0409502 and WO 89/11522, they do not deal with the specific problem of providing viscosity which is stable over time in fabric softening compositions comprising biodegradable quaternary ammonium material. Accordingly, the present invention sets out to provide fabric softening compositions comprising less than 30% by weight of a biodegradable quaternary ammonium material with improved viscosity stability characteristics.

The present inventors have discovered that surprisingly improved viscosity stability characteristics can be obtained in such compositions if a relatively small quantity of unsaturated fatty acid is used as a viscosity stabiliser.

DEFINITION OF THE INVENTION

According to a first aspect, the present invention provides a fabric softening composition comprising:

(a) less than 30% by weight on the composition of a quaternary ammonium fabric softening material which comprises two $C_{12}$–$C_{22}$ alkyl or alkenyl groups connected to the molecule via at least one ester link.

(b) an unsaturated $C_8$–$C_{24}$ fatty acid as a viscosity stabiliser wherein the weight ratio of quaternary ammonium material to unsaturated fatty acid is greater than 10:1.

In another aspect, the present invention provides the use of an unsaturated $C_8$–$C_{24}$ fatty acid to stabilise the viscosity of a fabric softening composition comprising less than 30% by weight of quaternary ammonium fabric softening material which comprises two $C_{12}$–$C_{22}$ alkyl or alkenyl groups connected to the molecule via at least one ester link, wherein the weight ratio of quaternary ammonium material to unsaturated fatty acid is greater than 10:1.

DETAILED DESCRIPTION OF THE INVENTION

The fabric softening compound is a quaternary ammonium material which preferably comprises a compound having two $C_{12-22}$ (preferably $C_{12-18}$) alkyl or alkenyl groups connected to the molecule via at least one ester link. It is more preferred if the quaternary ammonium material has two ester links present. The especially preferred ester-linked quaternary ammonium material for use in the invention can be represented by the formula:

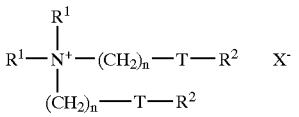

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups;

T is

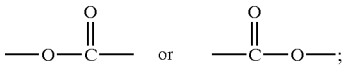

$X^-$ is any suitable anion including halide, acetate and lower alkosulphate ions and n is 0 or an integer from 1–5.

Especially preferred materials within this formula are di-alkenyl esters of triethanol ammonium methyl sulphate and N-N-di (tallowoyloxy ethyl) N,N-dimethylammonium chloride. Commercial examples of compounds within this formula include Tetranyl AHT-1 (di-hardened oleic ester of triethanol ammonium methyl sulphate 80% active), AO-1 (di-oleic ester of triethanol ammonium methyl sulphate 90% active), L5/90 (palm ester of triethanol ammonium methyl sulphate 90% active (supplied by Kao corporation) and Rewoquat WE15 ($C_{10}$–$C_{20}$ and $C_{16}$–$C_{18}$ unsaturated fatty acid reaction products with triethanolamine dimethyl sulphate quaternised 90% active), ex Witco Corporation.

A second preferred type of quaternary ammonium material can be represented by formula:

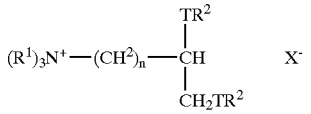

wherein $R^1$, $R^2$, $X^-$, n and T are as defined above.

Preferred materials of this class such as 1,2 bis[hardened tallowoyloxy]-3-trimethylammonium propane chloride and their method of preparation are, for example, described in U.S. Pat. No. 4,137,180 (Lever Brothers). Preferably these materials comprise small amounts of the corresponding monoester as described in U.S. Pat. No. 4,137,180 for example 1-hardened tallowoyloxy-2-hydroxy trimethylammonium propane chloride.

It is advantageous for environmental reasons if the quaternary ammonium material is biologically degradable.

The fabric softening agent may also be polyol ester quats (PEQs) as described in EP 0638 639 (Akzo).

The cationic fabric softening compositions used in the invention are compounds which provide excellent softening, characterised by a chain melting Lβ to Lα transition temperature greater than 25° C., preferably greater than 35° C., most preferably greater than 45° C. This Lβ to Lα transition can be measured by differential scanning calorimetry DSC as defined in the Handbook of Lipid Bilayers, D Marsh, CRC Press, Boca Raton Fla., 1990 (pages 137 and 337).

It is preferred if the softening compound is substantially insoluble in water. Substantially insoluble fabric softening compounds in the context of this invention are defined as fabric softening compounds having a solubility less than $1\times10^{-3}$ wt % in demineralised water at 20° C., preferably less than $1\times10^{-4}$ wt %, most preferably from $1\times10^{-6}$ to $1\times10^{-8}$ wt %.

If the quaternary ammonium compound comprises hydrocarbyl chains formed from fatty acids or fatty acyl compounds which are unsaturated or at least partially unsaturated (e.g. where the parent fatty acid or fatty acyl compound from which the quaternary ammonium compound is formed has an iodine value of from 5 to 140, preferably 5 to 100, more preferably 5 to 60, e.g. 5 to 40) then the cis:trans isomer weight ratio in the fatty acid or fatty acyl compound is greater than 20:80, preferably greater than 30:70, more preferably greater than 40:60, e.g. 70:30 or more. It is believed that higher ratios of cis to trans isomer afford the compositions comprising the quaternary ammonium compound better low temperature stability and minimal odour formation.

Saturated and unsaturated fatty acids or acyl compounds may be mixed together in varying amounts to provide a compound having the desired iodine value.

Alternatively, fatty acids or acyl compounds may be hydrogenated to achieve lower iodine values.

Of course the cis:trans isomer weight ratios can be controlled during hydrogenation by methods known in the art such as by optimal mixing, using specific catalysts and providing high $H_2$ availability.

Fabric softening compositions according to the present invention comprise aqueous dispersions of the above mentioned quaternary ammonium material. Fabric softening compositions preferably comprise 25% or less by weight of the quaternary ammonium material and preferably 4% or more by weight, more preferably 7% or more by weight most preferably 10% or more and 22% or less by weight, based on the total weight of the composition.

Unsaturated Fatty Acid Material

The unsaturated fatty acid material is a $C_8$–$C_{24}$ unsaturated fatty acid, in free acid form. It is particularly preferred that the composition should comprise $C_{14}$–$C_{23}$, e.g. $C_{18}$–$C_{22}$ unsaturated fatty acid. Unsaturated tallow fatty acid is especially preferred.

In the context of the present invention, "free acid form" means any unsaturated fatty acid present in the composition except those present due to dissociation of an ester-linked quaternary ammonium material.

In the context of the present invention "unsaturated" means that the fatty acid material is either fully or at least partially unsaturated. Thus, the unsaturated fatty acid material preferably has an iodine value of from 10 to 140, more preferably from 15 to 100, most preferably from 20 to 80, e.g. 25 to 70.

In the unsaturated compound, the weight ratio of cis:trans isomer is preferably from 20:80 to 150:1, more preferably from 30:70 to 125:1, most preferably from 40:60 to 99:1, e.g. 60:40 to 30:1.

Iodine Value of the Fatty Acid

In the context of the present invention, iodine value of the unsaturated fatty acid is defined as the number of grams of iodine which react with 100 grams of compound.

To calculate the iodine value of a fatty acid, a prescribed amount (from 0.1–3 g) of the fatty acid was dissolved into about 15 ml chloroform. The dissolved fatty acid was then reacted with 25 ml of iodine monochloride in acetic acid solution (0.1M). To this, 20 ml of 10% potassium iodide solution and about 150 ml deionised water was added. After addition of the halogen to the fatty acid had taken place, the excess of iodine monochloride was determined by titration with sodium thiosulphate solution (0.1M) in the presence of a blue starch indicator powder. At the same time a blank was determined with the same quantity of reagents and under the same conditions. The difference between the volume of sodium thiosulphate used in the blank and that used in the reaction with the fatty acid enabled the iodine value to be calculated.

Any suitable source of unsaturated fatty acid may be used. For example, it can be obtained by synthetic processes, for example oxidation of synthetic alcohols. Alternatively, the fatty acid may be obtained from natural materials.

The unsaturated fatty acid may be added in association with other materials, for example saturated fatty acid. The unsaturated fatty acid preferably represents 10–50% by weight, more preferably 15–30% by weight of the free fatty acid.

For example, the unsaturated fatty acid may be added in the form of unhardened tallow acid. Such unhardened tallow acid preferably contains in the range 19–21% unsaturated fatty acid mixed with saturated fatty acids.

The weight ratio of quaternary ammonium material to unsaturated fatty acid is greater than 10:1, preferably greater than 12:1, more preferably greater than 15:1. Preferably the weight ratio of quaternary ammonium material to unsaturated fatty acid is less than 500:1, more preferably less than 300:1, most preferably less than 200:1, e.g. less than 150:1. The total level of unsaturated fatty acid in the composition is suitably in the range 0.1–1.5%, more preferably 0.15–1.0%, most preferably 0.2–0.8% by weight based on the total weight of the composition.

Under some circumstances, some cationic fabric softening compositions having at least one ester link in the molecule can dissociate into an alkanol substituted quaternary ammonium material and a long chain fatty acid. Some quaternary ammonium material having at least one ester link in the molecule is made from fatty acid sources which have a certain degree of unsaturation. Unsaturated fatty acid present in the fabric softening composition due to disassociation of ester linked quaternary material is not included when measuring the weight ratio of quaternary ammonium material to unsaturated fatty acid. In effect, only fatty acid which is added to the composition is taken into account. Similarly, the quantity of quaternary ammonium fabric softening material is assessed as the quantity before any dissociation occurs. The quantities of undissociated quaternary ammonium material, the quantity of dissociated quaternary ammonium fabric softening material and the quantity of fatty acid can be determined by NMR or HPLC. From these data, the quantity of quaternary ammonium material before any dissociation occurred and the quantity of fatty acid produced by dissociation of quaternary ammonium material can be calculated. Further, it is possible to analyse the quaternary ammonium fabric softening material used to determine the level of unsaturation in the fatty acid used in its manufacture. From all this information, the total quantity of added unsaturated fatty acid can be determined.

Composition pH

The compositions of the invention preferably have a pH of at least 1.5, and/or less than 5, more preferably at least 2.5 and/or less than 4.

Additional Stabilising Agents

The compositions of the present invention may contain optional additional stabilising agents.

Compositions of the invention may also contain nonionic stabilisers. Suitable nonionic stabilisers which can be used include the condensation products of $C_8$–$C_{22}$ primary linear alcohols with 10 to 25 moles of ethylene oxide. Use of less than 10 moles of ethylene oxide, especially when the alkyl chain is in the tallow range, leads to unacceptably high aquatic toxicity. In particular the following nonionic stabilisers are preferred: Genapol T-110, Genapol T-150, Genapol T-200, Genapol C-200 all ex Hoechst, or fatty alcohols for example Laurex CS, ex Albright and Wilson or Adol 340 ex Sherex (all trade marks). Preferably the nonionic stabiliser has an HLB value of from 10 to 20, more preferably from 12 to 20. Preferably, the level of nonionic stabiliser is within the range of from 0.1 to 10% by weight, more preferably from 0.5 to 5% by weight, most preferably from 1 to 4% by weight. It has been surprisingly found that inclusion of unsaturated fatty acid allows a lower quantity of nonionic stabilising agent to be included. According to the present invention, the level of nonionic stabilising agent may be in the range 0.1–1% by weight, more preferably 0.15–0.75% by weight.

In a particularly preferred embodiment, the rinse conditioner composition further comprises at least one salt of a multivalent inorganic anion or multivalent non-sequestering organic anion as additional stabilising agent. This is described further in our co-pending application no. GB0002876.1. The multivalent anion is preferably divalent. Sulphate is particularly preferred. The counterion may be alkaline earth metal, ammonium, or alkali metal. The salt of multivalent anion is suitably present at a level 0.1–2.0%, more preferably 0.2–1.5%, most preferably 0.2–1.2% by weight, based on the total weight of the composition. The salt of the multivalent anion is substantially water soluble. Preferably, it has a solubility in excess of 1 g/l, preferably in excess of 25 g/l at 20° C.

Additional Viscosity Control Agent

Addition of unsaturated fatty acids according to the invention can lead to lower viscosities and additional viscosity control agents may be preferable.

Any viscosity control agent used with rinse conditioners is suitable for use with the present invention, for example biological polymers such as Xanthan gum (Kelco ex Kelsan and Rhodopol ex Rhodia), Guar gum (Jaguar ex Rhodia), starches and cellulose ethers. Synthetic polymers are useful viscosity control agents such as polyacrylic acid, poly vinyl pyrolidone, polyethylene, carbomers, cross linked polyacrylamides such as Acosol 880/882 polyethylene and polyethylene glycols.

Other Ingredients

The composition can also contain one or more optional ingredients, selected from electrolytes, non-aqueous solvents, pH buffering agents, perfumes, perfume carriers, colorants, hydrotropes, antifoaming agents, polymeric or other thickening agents, opacifiers, and anti-corrosion agents.

It is preferred if the compositions of the invention do not contain alkoxylated β-sitosterol compounds.

The composition of the present invention optionally includes an additional fabric treatment agent such as insect control agents, hygiene agents or compounds used to prevent the fading of coloured fabrics. Suitable fabric treatment agents are disclosed in WO 97/44424.

Processing

Compositions according to the present invention may be produced by any suitable method. Preferably, the compositions are produced by a melt method. In the melt method, the quaternary ammonium fabric softening compound is melted and mixed with the fatty acid and optional stabilising surfactant if required. A homogeneous mixture is produced.

Separately, an aqueous solution of the water-soluble components (electrolyte for example) is prepared at elevated temperatures (suitably in the range 50–100, preferably 60–85° C.). The molten active mixture is added slowly to the aqueous solution with stirring, preferably with additional longitudinal shear generated using a recycling loop. After a few minutes, perfume (if required) is added slowly and the mixture is stirred slowly to ensure thorough mixing. Finally, the composition is cooled at ambient temperature with continual stirring. This process can be modified in a number of ways.

1. Stabilising surfactant can be added directly to the aqueous solution. Preferably, this takes place after all the components have been mixed, whilst the composition is cooling. Perfume can be included at this stage as an emulsion.

2. Electrolyte may be added sequentially (in for example four portions) at the same time as the molten active is added to the aqueous solution.

The present invention will be further described by way of example only with reference to the following non-limiting examples.

EXAMPLES

Fabric conditioning compositions are produced by the following method. Cationic softener and fatty acid are melted together to form a co-melt. The co-melt is stirred to ensure homogeneity. Separately, an aqueous solution of electrolyte and polyethylene glycol, if present, at a temperature in the range 60–85° C. is prepared. The co-melt is slowly added to the aqueous solution with stirring. After a few minutes, perfume is added slowly and the mixture is further stirred to ensure thorough mixing. The resulting composition is cooled to ambient temperature with constant stirring. Stabilising surfactant can be added to the composition while it is cooling.

The viscosity stability characteristics of the resulting dispersions are measured by measuring the viscosity after various periods of storage and various temperatures.

Viscosity is measured using a Haake RC20 Rotoviscometer, using the NV spindle and bob.

Compositions Tested

Example 1

18.9% DEEDMAC[1]
0.65% fatty acid 5166[2]
1.0% perfume
0.2% Genapol C200[3]
1.8% sodium sulphate
1% PEG 1500[4]
water and minors to 100%

Example A (Comparative)

19.05% DEEDMAC[1]
0.49% Pristerene 4916[5]
0.2% Genapol C200[3]
1.8% sodium sulphate
1.0% perfume
water and minors to 100%

Example 2

19.05% DEEDMAC[1]
0.49% fatty acid Prifac 7920[6]
0.9% perfume
0.5% Genapol C200[3]
1.2% calcium chloride
water and minors to 100%

Examples 3–6

14.3% DEEDMAC[1]
0.37% Prifac 7920[6]
0.5% Genapol C200[3]
0.9% perfume
0.6, 0.8, 1.0, 1.2% calcium chloride (Examples 3, 4, 5 and 6 respectively)
water and minors to 100%

Example 7

14.51% DEEDMAC[1]
0.13% Wet Step Stearine[7]
0.5% Genapol C200[3]
0.9% perfume
1.2% calcium chloride
water and minors to 100%

Example 8

14.3% DEEDMAC[1]
0.185% Pristerine 4916[5]
0.185% Wet Step Stearine[7]
0.25% Genapol C200[3]
1.0% perfume
1.2% calcium chloride
water and minors to 100%

Comparative Example B 14.9% DEEDMAC[1]
0.37% Pristerene[5]
0.25% Genapol C200[3]
1.0% perfume
1.2% calcium chloride
water and minors to 100%

All quantities are in parts or percent by weight unless indicated otherwise.

Notes

1. DEEDMAC is di[2-(hardened tallowoyloxy)ethyl] dimethylammonium chloride. The raw material comprises quaternary ammonium material, hardened tallow fatty acid and isopropanol in a weight ratio 83:2:15. The percentage quoted includes the associated fatty acid.
2. Fatty acid 5166 is 21% unsaturated tallow fatty acid, ex Unichema.
3. Genapol C200 is coco alcohol ethoxylated with 20 moles of ethylene oxide, ex Hoechst.
4. PEG 1500 is poly(ethylene) glycol of mean molecular weight 1500.
5. Pristerine 4916 is hardened tallow fatty acid, ex Unichema.
6. Prifac 7920 is 47% unsaturated tallow fatty acid ex Unichema.
7. Wet Step Stearine is 19% unsaturated tallow fatty acid, ex Unichema.

Results

| | Viscosity (mPa · s at 106 $s^{-1}$ and ambient temp.) | | |
|---|---|---|---|
| Example | after 1 wk at ambient | after 5 wks at 0° C. | after 5 wks at 37° C. |
| 1 | 22 | 31 | 26 |
| Comparison A | 31 | 89 | 39 |
| Comparison B | 28 | 25 | 71 |

The table shows the viscosity, as measured under conditions indicated after storage of the compositions listed for the time period indicated, and at the temperatures indicated.

Composition 1 and Comparison Example A are very similar in composition. Comparative Example A shows a very major increase in viscosity after storage at 0° C. for 5 weeks.

Comparison Example B is similar to Example 8. Although Comparison Example B shows good storage stability at 0° C., it has a very poor stability on storage at 37° C. In contrast, Example 8 according to the invention has acceptable stability at both 0° C. and 37° C.

What is claimed is:

1. A fabric softening composition comprising an aqueous dispersion of:

(a) from 4 to 25% by weight of a quaternary ammonium fabric softening material represented by the formula:

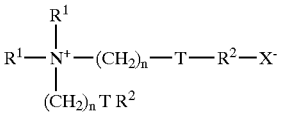

wherein each $R^1$ group is independently selected from $C_{1-4}$ alkyl, hydroxy alkyl or $C_{2-4}$ alkenyl groups; and wherein each $R^2$ group is independently selected from $C_{8-28}$ saturated alkyl groups;

T is

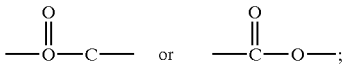

$X^-$ is any suitable anion including halide, acetate and lower alkosulphate ions and n is 0 or an integer from 1–5; and (b) an unsaturated $C_8$–$C_{24}$ fatty acid as a viscosity stabiliser, wherein the cis:trans isomer weight ratio in the unsaturated fatty acid is from 20:80 to 150:1, and wherein the weight ratio of said quaternary ammonium material to said unsaturated fatty acid is greater than 12:1.

2. A fabric softening composition according to claim 1, further comprising at least one salt of a multivalent inorganic anion or non-sequestering multivalent organic anion.

3. A fabric softening composition as claimed in claim 1 wherein the fatty acid material is an unsaturated $C_{18}$–$C_{22}$ fatty acid.

4. A fabric softening composition as claimed in claim 1 wherein the iodine value of the fatty acid is from 10 to 140.

5. A fabric softening composition as claimed in claim 1 wherein the cis:trans isomer weight ratio in the unsaturated fatty acid is from 40:60 to 99:1.

* * * * *